United States Patent [19]

Ohno et al.

[11] Patent Number: 4,804,606

[45] Date of Patent: Feb. 14, 1989

[54] ELECTROPHOTOGRAPHIC SENSITIZED BODY HAVING A DIFFUSION BLOCKING LAYER

[75] Inventors: Toshiyuki Ohno, Hitachi; Kunihiro Tamahashi, Mito; Mitsuo Chigasaki, Hitachi, all of Japan

[73] Assignee: Hitachi, Ltd., Tokyo, Japan

[21] Appl. No.: 92,304

[22] Filed: Sep. 2, 1987

[30] Foreign Application Priority Data

Sep. 3, 1986 [JP] Japan ..... 61-205974

[51] Int. Cl.[4] ..... G03G 5/14

[52] U.S. Cl. ..... 430/57; 430/65; 430/69; 430/84

[58] Field of Search ..... 430/52, 65, 66, 69, 430/84; 357/30 K, 67; 437/190

[56] References Cited

U.S. PATENT DOCUMENTS

| | | | |
|---|---|---|---|
| 4,521,800 | 6/1985 | Howe | 357/67 |
| 4,640,004 | 2/1987 | Thomas et al. | 437/190 |
| 4,641,168 | 2/1987 | Yamazaki et al. | 357/30 K |
| 4,687,723 | 8/1987 | Ohshima et al. | 430/65 |

*Primary Examiner*—John L. Goodrow

*Attorney, Agent, or Firm*—Antonelli, Terry & Wands

[57] ABSTRACT

An electrophotographic sensitized body having a photoconductive layer comprising hydrogenated amorphous silicon on a substrate which comprises conductive material selected from the group consisting of Al, Al-Si (0.2–1.2 wt. %) - Mg (0.45–1.2 wt. %) alloy, super duralmine and extra super duralmine. Provided between the substrate and the photoconductive layer is a diffusion blocking layer 0.005–5 microns in thickness comprising a material selected from the group consisting of titanium nitride, tantalum nitride, hafnium nitride, platinum silicide, nickel silicide, palladium silicide, titanium silicide, hafnium silicide, tantalum silicide, tungsten silicide, vanadium silicide, niobium silicide, molybdenum silicide, zirconium silicide, tungsten carbide, titanium carbide, molybdenum carbide, hafnium carbide, vanadium carbide, niobium carbide, tantalum carbide and metallic chrome. The decrease in specific resistance of the photoconductive layer caused by diffusion of the substrate constituent to the photoconductive layer is prevented and the sensitivity to the light in the region of oscillatory wavelength of semiconductor is remarkably improved.

23 Claims, 2 Drawing Sheets

(a) --- CASE WITH NO DIFFUSION BLOCKING LAYER
(b) --- EXAMPLE 1
(c) --- EXAMPLE 2
(d) --- EXAMPLE 3

ELECTROPHOTOGRAPHIC SENSITIZED BODY HAVING A DIFFUSION BLOCKING LAYER

BACKGROUND OF THE INVENTION

1. Field of the Invention

The present invention relates to an electrophotographic sensitized body which is particularly suitable for laser beam printers using a semiconductor laser.

2. Description of the Related Art

An electrophotographic sensitized body is provided with a photoconductive layer which comprises photoconductive material on the surface of a metallic substrate. As the photoconductive material with high resistance used for the photoconductive layer of this electrophotographic sensitized body, amorphous semiconductor, e.g. hydrogenated amorphous silicon, is given attention. This material shows high photosensitivity in the visible light range, high hardness and low toxicity, compared with the conventional photoconductive material comprising amorphous selenium or organic photoconductor. However, the photosensitivity around 780–800 nm, the region of oscillatory wavelength of the semiconductor laser, is not high and further sensitization in this region is desired.

To improve the sensitivity in a particular wavelength region, following two conditions are extremely important:

(i) On irradiation of light in the given wavelength region, pairs of electrons and positive holes are readily created in the photoconductive layer. In other words, an optical band gap, corresponding to the wavelength region concerned, must exist in the photoconductive layer.

(ii) The pairs of electrons and positive holes created in (i) must be moved quickly in the photoconductive layer by the electric field, which is produced between positive charges applied on the surface of the sensitized body and negative charges induced on the interface between the substrate and photoconductive layer. (The sign of the charges may sometimes be inverted.) In other words, the mobility of electrons and positive holes in the photoconductive layer must be large.

Particularly in (ii), it is well known that not only the mobility of the electrons which directly neutralize the positive charges on the surface of the sensitized body but that of the positive holes which neutralize the negative charges on the surface of the substrate is important.

In addition to having sufficient sensitivity, the electrophotographic sensitized body must further meet following two conditions:

(iii) The specific resistance of the photoconductive layer must be over $10^{10}$ Ωcm in order to prevent the discharge of the charges, which have been applied by Corona discharge etc. on the surface of the sensitized body across the thickness of the photoconductive layer before the light exposure.

(iv) After the light exposure, in order to prevent disappearance of the charge pattern formed on the surface of the sensitized body before development due to the charge's lateral mobility, the surface resistance of the sensitized body must be adequately high, i.e. over $10^{10}$ Ωcm in specific resistance convertedly.

The hydrogenated amorphous silicon usually has an optical band gap of about 1.8 eV, indicating a good photosensitivity for light around 600–650 nm, the region of oscillatory wavelength of the gas laser using He gas or Ne gas, but an abrupt drop in photosensitivity around 780–800 nm (the range corresponding to the optical band gap of about 1.5 eV), the region of oscillatory wavelength of the semiconductor laser. Methods like Ge- and Sn-addition to the amorphous silicon were found to reduce the optical band gap of this material, as is reported, e.g. in "Modern Amorphous Silicon Handbook", pp. 200–201, 221–223 (Mar. 31, 1973) published by Science Forum Co., Ltd. However, these methods lead to an unfavorable result that specific resistance of the sensitized body is reduced.

In order to avoid this drawback, a composition of sensitized body has been proposed, as is detailed, e.g., in Japanese Patent Application Kokai (Laid-Open) No. 219565/83.

Namely, it is the composition in which the hydrogenated amorphous silicon carbide layer, which has a comparatively large optical band gap and specific resistance, is deposited on the photoconductive layer and on the interface between the photoconductive layer and its substrate. This layer on the sensitized body surface is called "surface coating layer", and that on the interface is called "barrier layer". The surface coating layer is effective against lateral redistribution of the charges on the surface and discharge in the direction of the layer thickness. On the other hand, the barrier layer effectively blocks the charge implantation from the substrate into the photoconductive layer. These measures improve photosensitivity in the region of oscillatory wavelength of the semiconductor laser to some extent.

However, investigations by the present inventors have disclosed a problem of contamination in the photoconductive layer by diffusion of the substrate's constituent elements through the barrier layer. The diffusion of the substrate's constituent metal is due to the heating in the processes to prepare the barrier layer, photoconductive layer and surface coating layer. More concretely put, these layers are usually prepared by sputtering, plasma CVD or evaporation process. In these formation processes, the substrate is heated to around 200°–300° C., partial diffusion of the substrate's constituent elements into the barrier layer and photoconductive layer. By this diffusive contamination, an impurity level is formed inside the band gap of the photoconductive layer, or the specific resistance is reduced. For example, when the substrate is made of Al and the photoconductive layer of amorphous silicon, Al contaminates the amorphous silicon reducing the resistance of the sensitized body. Consequently, the effect of electric field on the electrons and positive holes in the photoconductive layer is reduced, the travel efficiency of the electrons and positive holes created by photo-absorption becomes worse and the photosensitivity decreases. Furthermore, the trap level of electrons and positive holes by the diffused metal as impurity in the silicon causes reduction of the mobility.

The phenomenon that the substrate's constituent metals diffuse into the photoconductive layer was observed in all cases where hydrogenated amorphous silicon was used as material for the photoconductive layer, irrespective of the presence of a barrier layer. It was confirmed that the decrease in resistance and the deterioration of photosensitivity of the photoconductive layer were caused by such diffusion of the substrate constituents into the photoconductive layer.

SUMMARY OF THE INVENTION

OBJECTS OF THE INVENTION

The object of the present invention is providing an electrophotographic sensitized body with a composition in which diffusion of the constituent metal of the substrate and, therefore, contamination of the photoconductive layer are avoidable.

STATEMENT OF THE INVENTION

The object mentioned above is achieved in a body which has the photoconductive layer comprising hydrogenated amorphous silicon on the conductive metallic substrate, by providing the diffusion blocking layer, which practically blocks the diffusion of constituent metal of the substrate, on the interface boundary between substrate and photoconductive layer. This diffusion blocking layer desirably has a transferable thickness (practically 0.005–5 microns) by charges from the photoconductive layer to the substrate.

By blocking the diffusion of constituent element of the substrate into the photoconductive layer, the reduction of resistance of the photoconductive layer and the formation of trap level can be prevented.

The material used for the diffusion blocking layer desirably has a comparatively small specific resistance, practically under $10^{-1}$ Ωcm (preferably under $10^{-5}$ Ωcm).

In such a composition, charges in the photoconductive layer can easily pass through into the substrate. An example of the layer with insulating oxide film provided between the substrate and photoconductive layer is illustrated in Japanese Patent Application Kokai (Laid-Open) No. 14140/83, but it is not appropriate because of its high resistance ($10^{10}$ to $10^{16}$ Ωcm).

Preferable materials, meeting requirements of the diffusion blocking properties and low resistance to various constituent metals of the substrate such as Al etc., are nitrides, silicides and carbides of transition metals; particularly titanium nitride, tantalum nitride, hafnium nitride, platinum silicide, nickel silicide, palladium silicide, titanium silicide $TiSi_2$, hafnium silicide, tantalium silicide, tungsten silicide, vanadium silicide, niobium silicide, molybdenum silicide, zirconium silicide, tungsten carbide, titanium carbide, molybdenum carbide, hafnium carbide, vanadium carbide, niobium carbide and tantalum carbide. These compounds are strongly binding and not chemically active, so good diffusion blocking effect is expected as the diffusion blocking layer. By the sputtering process etc., a thin film with 0.005–5 micron thickness is readily produced. Particularly, titanium nitride is most preferable because of its thermal stability and low specific resistance as $10^{-4}$ to $10^{-5}$ Ωcm. Also, tantalum nitride and hafnium nitride are effective for the same reason.

Since metal silicides have specific resistance within the order of $10^{-4}$ to $10^{-5}$ Ωcm, they are also suitable for the material of diffusion blocking layer. Specific resistance of the main metal silicides are shown as follows:

PtSi: $2.8–3.5\times10^{-5}$ Ωcm
NiSi: approx. 5.0
$Pd_2Si$: 3.0–3.5
$TiSi_2$: 1.3–2.5
$HfSi_2$: 4.5–7.0
$TaSi_2$: 3.5–5.5
$WSi_2$: approx. 7.0
$VSi_2$: 5.0–5.5
$NbSi_2$: approx. 5.0
$MoSi_2$: 9.0–10.0
$ZrSi_2$: 3.5–4.0

As the material of the substrate supporting the photoconductive layer, the following materials are available besides Al:

Al-Si (0.2–1.2 wt. %) - Mg (0.45–1.2 wt. %)

alloy, super duralmine, extra super duralmine and austenitic stainless steel containing Ni and Cr.

If metal nitrides, for example, are used for the diffusion blocking layer, it is desirable for the selection of metal nitride to be done in the manner that the bond strength between nitrogen and the metal constituting the metal nitride should be stronger than that between nitrogen and the element diffusing from the substrate to the photoconductive layer. Thus, the metal nitride constituting the diffusion blocking layer is kept stable, being prevented from the bond rupture and configurational change caused by the diffusing element.

Nitrides, silicides and carbides, which were already shown as the materials of diffusion blocking layer, adequately show the diffusion blocking effect with each of the substrates comprising Al, Al-Si-Mg alloy, super duralmine, extra super duralmine and austenitic stainless steel.

As for the mechanism to be able to block the diffusion of constituent metal of the substrate into the photoconductive layer, besides the case where the material of diffusion blocking layer is entirely inactive to the diffusing element as mentioned previously, another case exists where the diffusion element is trapped by a produced stable intermetallic compound between the diffusing element and constituent metal of the substrate. The latter case is, for example, concerned with metal silicides of Pt, Ni and Pd. These metal silicides readily produce intermetallic compounds with trapped Al. Also, the produced intermetallic compounds with Al usually have small specific resistance as $10^{-4}$ to $10^{-5}$ Ωcm and therefore, become an effective diffusion blocking layer. Here, the intermetallic compounds produced by metal silicide and Al do not always cover the whole region of the diffusion blocking layer, being rather limited to its surface in contact with the substrate. When the substrate comprises Al or Al alloy, formation of a metallic Cr layer between the metal silicides of Pt, Ni and Pd and the Al-substrate with 0.005–5 micron total thickness of the metal silicide and metallic Cr layer is desirable. Only the metallic Cr layer, without the metal silicide layer, is effective to interfere with the diffusion of Al into the photoconductive layer. In this case, the thickness of the layer, which is essential to determine the appropriate range of resistance, is preferably 0.005–5 microns.

The diffusion blocking layer provided between the substrate and photoconductive layer thus prevents the photoconductive layer from decrease in its specific resistance and formation of trap level, and consequently deterioration of travel efficiency of electrons and positive holes formed by laser absorption. Furthermore, with the specific resistance of the diffusion blocking layer kept below $10^{-1}$ cm, the charges can not be prevented from easily passing through the substrate side.

The present invention is applicable to the electrophotographic sensitized body in which the photoconductive layer is directly formed on the metallic substrate or to the electrophotographic sensitized body in which the photoconductive layer comprising hydrogenated amorphous silicon is formed on the metal substrate by interposing another layer, e.g. an amorphous silicon carbide layer between two.

The electrophotographic sensitized body is usually used in the state that the surface mostly exposed to the air is covered by a protective layer, e.g., an amorphous silicon carbide layer or an amorphous carbon layer. In the present invention, such kind of use with a protective layer is available, as a matter of course. The photoconductive layer is not necessarily a monolayer, but may be a multilayer, such as a double or a triple layer with additional composition varieties within the range of keeping hydrogenated amorphous silicon configuration. Here, the photoconductive layer comprising hydrogenated amorphous silicon not only means simple hydrogenated amorphous silicon, but also includes that doped with B, P or Ge.

EXAMPLES

The following examples are illustrative of the present invention and are not intended as a limitation of the scope thereof. Regarding the preparation of the diffusion blocking layer, methods of sputtering, electron beam deposition and ion cluster beam deposition are applicable. As for the preparation of the hydrogenated amorphous silicon photoconductive layer, methods of plasma CVD, sputtering and electron beam deposition are applicable. Also, for the preparation of the other kinds of layer in the sensitized body mentioned above, some of the methods mentioned above can be applied.

Figure 1:
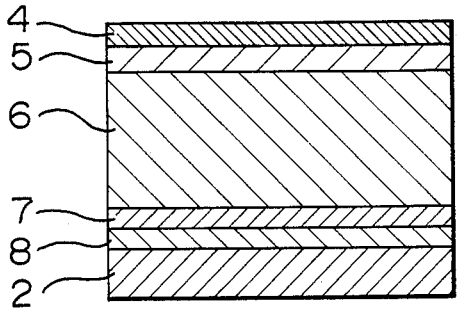
FIG. 1 is a cross-sectional representation of the electrophotographic sensitized body according to a preferred embodiment of the invention.

FIG. 1 is a cross-sectional representation of the electrophotographic sensitized body according to one embodiment of this invention. The photographic sensitized body of this Example has a photoconductive layer comprising an upper photoconductive layer and a lower photoconductive layer. The upper photoconductive layer is provided with the surface coating layer, and the lower photoconductive layer is provided with the barrier layer below it which blocks the implantation of charges from the substrate to the photoconductive layer.

The electrophotographic body of this Example has a series of layers, i.e. diffusion blocking layer 8, barrier layer 7, lower photoconductive layer 6, upper photo conductive layer 5 and surface coating layer 4 as the uppermost part, outward from the substrate 2. The surface coating layer 4 and barrier layer 7 have a comparatively high optical band gap and high specific resistance. The upper photoconductive layer 5 has a comparatively small optical band gap and produces pairs of electrons and positive holes upon absorbing the semiconductor laser beam. The lower photoconductive layer 6 has higher specific resistance than that of the upper photoconductive layer 5 in order not to decrease the resistance of the sensitized body as a whole. By the presence of this lower photoconductive layer, the electrification properties of the sensitized body as a whole are improved and the electric field imposed on the electrons and positive holes is increased, and, accordingly, the travel efficiencies of electrons and positive holes are considerably improved.

In this practical example, the diffusion blocking layer 8 is provided between the barrier layer 7 and the substrate 2. This layer has the function mentioned previously, and details of its practical material and layer preparation method are described as follows:

EXAMPLE 1

(1) As the substrate, an aluminum drum with its surface planished by diamond bits is used. It is placed in a vacuum chamber, and after evacuation to around $1\times10^{-6}$ Torr with the surface temperature the drum kept at 200° C., argon gas is introduced into the chamber up to a pressure of 0.01 Torr. Sputtering is conducted with a high frequency wave of 13.56 MHz and 200 W power using a 80 mm-diameter titanium nitride target, and the diffusion blocking layer 8 with 100 nm thickness of titanium nitride film is prepared.

(2) While keeping the surface temperature of the aluminum drum at 200° C., the vacuum chamber is evacuated again up to $1\times10^{-6}$ Torr, and then a mixed gas of argon, ethylene ($C_2H_4$) and hydrogen ($H_2$) is introduced until the inner pressure becomes 0.01 Torr. The gas ratio is controlled at $H_2/(Ar+H_2)=0.6$ and $C_2H_4/(H_2+C_2H_4)=0.3$. The sputtering is conducted with a high frequency wave of 13.56 MHz and 200 W, using a 80 mm - diameter silicon target and the barrier layer 7 with 100 nm deposit thickness of hydrogenated amorphous silicon carbide (a-$Si_{l-x}Cx$:H) film is prepared.

(3) While the surface temperature of the aluminum drum is kept at 200° C., the vacuum chamber is evacuated up to around $1\times10^{-6}$ Torr, and then a mixed gas of argon and hydrogen is introduced up to the pressure of 0.01 Torr. The gas ratio is $H_2/(Ar+H_2)=0.6$. Sputtering is conducted with a high frequency wave of 13.56 MHz and 200 W, and the lower photoconductive layer 6 with 20 micron deposit thickness of hydrogenated amorphous silicon (a-Si:H) film is prepared.

(4) Sputtering is conducted with a method similar to (3), except the 80 mm-diameter silicon target on which a germanium chip is placed with the area ratio of 0.2 to the whole target, and the upper photoconductive layer 5 with 3 micron deposit thickness of hydrogenated amorphous silicon germanium (a-$Si_{l-x}$ Gex:H) film is prepared, which is more practically described as follows: After the target mentioned previously was set in a vacuum chamber and the chamber is evacuated, mixed a gas of argon and hydrogen was introduced into the vacuum chamber up to the pressure of 0.01 Torr. The gas ratio is $H_2/(Ar+H_2)=0.6$. While surface temperature of the drum is kept at 200° C., sputtering was conducted with a high frequency wave of 13.56 MHz and 200 W and the upper photoconductive layer was prepared.

(5) While the surface temperature of the aluminum drum is kept at 200° C., the vacuum chamber is evacuated again to the pressure of around $1\times10^{-6}$ Torr and mixed gas of argon, ethylene and hydrogen is introduced up to the pressure of 0.01 Torr. The gas ratio is $H_2/(Ar+H_2)=0.6$ and $C_2H_4/(H_2+C_2H_4)=0.6$. The sputtering is conducted with a high frequency wave of 13.56 MHz and 200 W, using a 80 mm diameter silicon target and the surface coating layer 4 with 500 nm deposit thickness of hydrogenated amorphous silicon carbide film is prepared.

The electrophotographic sensitized body was produced by these procedures described in (1)-(5). The spectral sensitivity characteristics of the electrophotographic sensitized body are illustrated by curve (b) in FIG. 2 (*b*).

Figure 2:
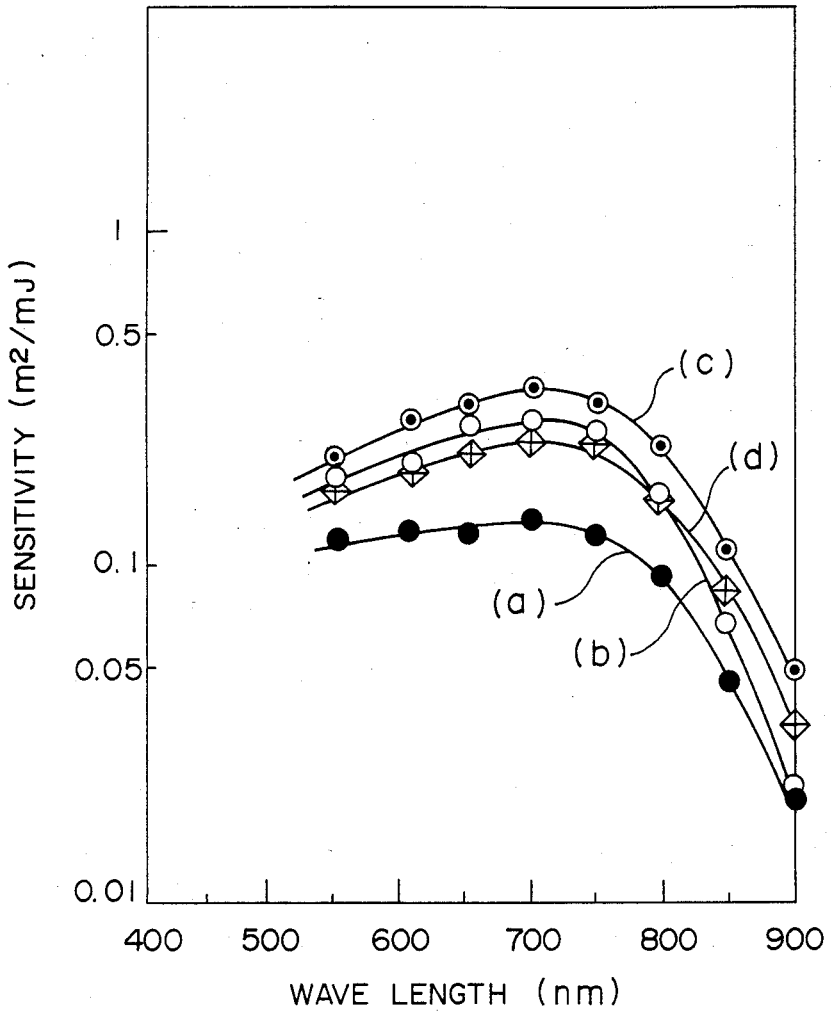
FIG. 2 illustrates the spectral sensitivity characteristics of the electrophotographic sensitized body according to preferred embodiments of the invention and a Comparative Example.

As a comparative example, the spectral sensitivity characteristics of the electrophotographic sensitized body provided with surface coating layer 4, upper photoconductive layer 5, lower photoconductive layer 6 and barrier layer 7, but with diffusion blocking layer 8, are illustrated by curve (a) in FIG. 2. By comparison of these sensitized bodies, it is clarified that the spectral sensitivity characteristics are improved for beams in the regions of oscillatory wavelength at 600-650 nm for the gas laser and 780-800 nm for the semiconductor laser, by providing the diffusion blocking layer 8.

EXAMPLE 2

(i) This example demonstrates the barrier layer and surface coating layer prepared with amorphous silicon carbide and the lower photoconductive layer prepared with boron-doped hydrogenated amorphous silicon.

After an aluminum drum planished with diamond bits is placed in a vacuum chamber evacuated to around $1\times10^{-8}$ Torr, with surface temperature of the drum kept at 300° C., argon and nitrogen ($N_2$) gases are introduced up to a pressure of 0.01 Torr. Sputtering is conducted with a high frequency wave of 13.56 MHz and 200 W power, using a 80 mm diameter titanium target and the diffusion blocking layer 8 with 100 nm thickness titanium nitride film is prepared.

(ii) While the surface temperature of drum is kept at 300° C., the vacuum chamber is evacuated again to $1\times10^{-8}$ Torr and a mixed gas of monosilane ($SiH_4$), ethylene and hydrogen is introduced up to the pressure of 0.3 Torr. The gas ratio is adjusted to $(SiH_4+C_2H_4)/(H_2+SiH_4+C_2H_4)=0.25$ and $C_2H_4/(SiH_4+C_2H_4)=0.25$. Through glow discharge with a high frequency wave of 13.56 MHz and 100 W power, the barrier layer 7 with 100 nm deposit thickness of amorphous silicon carbide film is prepared.

(iii) After evacuation of the vacuum chamber up to $1\times10^{-6}$ Torr, a mixed gas of monosilane, diborane ($B_2H_6$) and hydrogen is introduced up to 0.3 Torr. The gas ratio is controlled at $SiH_4/(H_2+SiH_4)=0.25$ and $B_2H_6/SiH_4=5\times10^{-4}$. With the surface temperature of the aluminum drum kept at 300° C., by glow discharge with a high frequency wave of 13.56 MHz and 200 W power, the lower photoconductive layer 6 with 20 micron deposit thickness of boron-doped hydrogenated amorphous silicon film is prepared.

(iv) After the vacuum chamber is evacuated again to $1\times10^{-6}$ Torr, a mixed gas of monosilane, germane and hydrogen is introduced up to the pressure of 0.3 Torr. The gas ratio is adjusted to $(SiH_4+GeH_4)/(H_2+SiH_4+GeH_4)=0.25$ and $GeH_4/(SiH_4+GeH_4)=0.3$. While the surface temperature of the aluminum drum is kept at 300° C., by glow discharge with a high frequency wave of 13.56 MHz and 100 W power, the upper photoconductive layer 5 with 3 micron deposit thickness of hydrogenated amorphous silicon germanium film is prepared.

(v) After evacuation of the vaccum chamber to $1\times10^{-6}$ Torr, a mixed gas of monosilane, ethylene and hydrogen is introduced to 0.3 Torr. The gas ratio is adjusted to $(SiH_4+C_2H_4)/(H_2+SiH_4+C_2H_4)=0.25$ and $C_2H_4/(SiH_4+C_2H_4)=0.5$. With the surface temperature of the aluminum drum kept at 300° C., by glow discharge with a high frequency wave of 13.56 MHz and 100 W power, the surface coating layer 4 with 500 nm deposit thickness of amorphous silicon carbide film is prepared.

The spectral sensitivity characteristics of electrophotographic sensitized body, produced by the procedures (i)-(v) mentioned above, are shown by curve (c) in FIG. 2. The spectral sensitivity characteristics in Example 2, with respect to the light in the region of oscillatory wave length by either the gas laser or the semiconductor laser, are superior to those in Example 1.

EXAMPLE 3

The diffusion blocking layer, comprising two layers, i.e. a metallic chrome layer and a nickel silicide layer, is illustrated in this case.

(a) After an aluminum drum planished with diamond bits is placed in a vacuum chamber evacuated to around $5\times10^{-7}$ Torr, with surface temperature of the drum kept at 300° C., a 100 nm thickness metallic chrome film is prepared by the electron beam deposition.

(b) While the surface temperature of the aluminum drum is kept at 300° C., the vacuum chamber is evacuated to $1\times10^{-6}$ Torr, and then argon is introduced to 0.01 Torr. Using a 80 mm diameter polycrystalline silicon target, on which nickel pieces are scattered, sputtering is conducted with a high frequency wave of 13.56 MHz and 200 W power and a 500 nm thickness nickel silicide film is prepared. Those two layers of metallic chrome and nickel silicide prepared by (a) and (b) are regarded as the diffusion blocking layer.

(c) By the same procedure with processes (2)-(5) shown in Example 1, barrier layer 7, lower photoconductive layer 6, upper photoconductive layer 5 and surface protective layer 4 are prepared.

Figure 3:
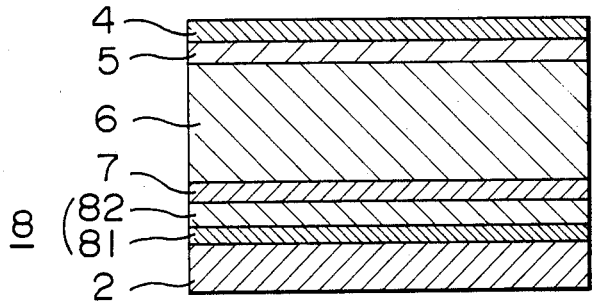
FIG. 3 is a cross-sectional representation of the electrophotographic sensitized body according to another preferred embodiment of the invention.

The cross-sectional drawing of the electrophotographic sensitized body produced by these processes is shown in FIG. 3. The diffusion blocking layer 8 comprises metallic chrome layer 81 and nickel silicide layer 82.

The spectral sensitivity characteristics of the electrophotographic sensitized body, produced by the processes (a)-(c) mentioned above, are shown by curve (d) in FIG. 2. The characteristics with respect to the light in the region of oscillatory wavelength of 600-650 nm of the gas laser are somewhat inferior to those of Examples 1 and 2, but are remarkably good compared with conventional ones; furthermore, those of Example 3 with respect to the light in the region of oscillatory wavelength 780-800 nm of the semiconductor laser are confirmed to be superior to those of Example 1.

According to the present invention, the diffusion of constituent metal of the substrate into the photoconductive layer, which occurs during the production process of the electrophotographic sensitized body, can be blocked and prevention of decrease in specific resistance is effected. As a result, the electrophotographic sensitized body in the present invention has good sensitivity to the light of 780-800 nm in the region of oscillatory wavelength of the semiconductor laser and of 600-650 nm in the region of oscillatory wavelength of the gas laser.

What is claimed is:

1. An electrophotographic sensitized body which has a photoconductive layer which comprises hydrogenated amorphous silicon on a metallic conductive substrate; characterized by being provided between said substrate and said photoconductive layer with a diffusion blocking layer which has a function to block the diffusion of atoms from said substrate into said photoconductive layer and specific resistance under $10^{-1}$ Ωcm.

2. An electrophotographic sensitized body according to claim 1, wherein the material of said conductive substrate is the one selected from group consisting of Al, Al-Si (0.2–1.2 wt. %) - Mg (0.45–1.2 wt. %) alloy, super duralmine, extra super duralmine and austenitic stainless steel containing Ni and Cr.

3. An electrophotographic sensitized body which has a barrier layer on a metallic conductive substrate with a function to block the implantation of charges from said substrate to a photoconductive layer which comprises hydrogenated amorphous silicon on said barrier layer; characterized by being provided between said substrate and said barrier layer with a diffusion blocking layer which has a function to block the diffusion of atoms from said substrate into said photoconductive lyer and specific resistance under $10^{-1}$ Ωcm.

4. An electrophotographic sensitized body which has a photoconductive layer comprising hydrogenated amorphous silicon on a conductive substrate which comprises a material selected from the group consisting of Al, Al-Si (0.2–1.2 wt. %) - Mg (0.45–1.2 wt. %) alloy, super duralmine and extra super duralmine; characterized by being provided between said substrate and said photoconductive layer with a diffusion blocking layer 0.005–5 microns in thickness which comprises a material selected from, the group consisting of titanium nitride, tantalum nitride, hafnium nitride, platinum silicide, nickel silicide, palladium silicide, titanium silicide, hafnium silicide, tantalum silicide, tungsten silicide, vanadium silicide, niobium silicide, molybdenum silicide, zirconium silicide, tungsten carbide, titanium carbide, molybdenum carbide, hafnium carbide, vanadium carbide, niobium carbide, tantalum carbide and metallic chrome.

5. An electrophotographic sensitized body which has on a conductive substrate comprising a material selected from the group consisting of Al, Al-Si (0.2–1.2 wt. %) - Mg (0.45–1.2 wt. 5) alloy, super duralmine and extra super duralmine a barrier layer comprising either hydrogenated amorphous silicon carbide or amorphous silicon carbide with a function to block the implantation of charges from the substrate and into a photoconductive layer comprising hydrogenated amorphous silicon on top of said barrier layer; characterized by being provided between said substrate and said barrier layer with a diffusion blocking layer 0.005–5 microns in thickness which comprises a material selected from the group consisting of titanium nitride, tantalum nitride, hafnium nitride, platinum silicide, nickel silicide, palladium silicide, titanium silicide, hafnium silicide, tantalum silicide, tungsten silicide, vanadium silicide, niobium silicide, molybdenum silicide, zirconium silicide, tungsten carbide, titanium carbide, molybdenum carbide, hafnium carbide, vanadium carbide, niobium carbide, tantalum carbide and metallic chrome.

6. An electrophotographic sensitized body having on a conductive substrate which comprises a material selected from the group consisting of Al, Al-Si (0.2–1.2 wt. %) - Mg (0.45–1.2 wt. %) alloy, super duralmine and extra super duralmine a photoconductive layer comprising hydrogenated amorphous silicon on whose upper part a surface coating layer is located; characterized by being provided between said substrate and said photoconductive layer with a diffusion blocking layer 0.005–5 microns in thickness comprising a material selected from the group consisting of titanium nitride, tantalum nitride, hafnium nitride, platinum silicide, nickel silicide, palladium silicide, titanium silicide, hafnium silicide, tantalum silicide, tungsten silicide, vanadium silicide, niobium silicide, molybdenum silicide, zirconium silicide, tungsten carbide, titanium carbide, molybdenum carbide, hafnium carbide, vanadium carbide, niobium carbide, tantalum carbide and metallic chrome.

7. An electrophotographic sensitized body according to claim 6, wherein said surface coating layer is characterized by comprising either amorphous silicon carbide or hydrogenated amorphous silicon carbide.

8. An electrophotographic sensitized body which has on a conductive substrate comprising a material selected from the group consisting of Al, Al-Si (0.2–1.2 wt. %) - Mg (0.45–1.2 wt. %) alloy, super duralmine and extra super duralmine a barrier layer comprising either hydrogenated amorphous silicon carbide or amorphous silicon carbide with a function to block the implantation of charges from the substrate into a photoconductive layer comprising hydrogenated amorphous silicon on said barrier layer and has a surface coating layer in the upper part of said photoconductive layer; characterized by being provided between said substrate and said barrier layer with a diffusion blocking layer 0.005–5 microns in thickness comprising a material selected from the group consisting of titanium nitride, tantalum nitride, hafnium nitride, platinum silicide, nickel silicide, palladium silicide, titanium silicide, hafnium silicide, tantalum silicide, tungsten silicide, vanadium silicide, niobium silicide, molybdenum silicide, zirconium silicide, tungsten carbide, titanium carbide, molybdenum carbide, hafnium carbide, vanadium carbide, niobium carbide, tantalum carbide and metallic chrome.

9. An electrophotographic sensitized body according to claim 8, wherein said surface coating layer is characterized by comprising either amorphous silicon carbide or hydrogenated amorphous silicon.

10. An electrophotographic sensitized body which has a photoconductive layer with an at-least-two-layer structure comprising hydrogenated amorphous silicon on conductive substrate comprising a material selected from the group consisting of Al, Al-Si (0.2–1.2 wt. %) - Mg (0.45–1.2 wt. %) alloy, super duralmine and extra super duralmine; characterized by being provided between said substrate and said photoconductive layer with a diffusion blocking layer 0.005–5 microns in thickness comprising a material selected from the group consisting of titanium nitride, tantalum nitride, hafnium nitride, platinum silicide, nickel silicide, palladium silicide, titanium silicide, hafnium silicide, tantalum silicide, tungsten silicide, vanadium silicide, niobium silicide, molybdenum silicide, zirconium silicide, tungsten carbide, titanium carbide, molybdenum carbide, hafnium carbide, vanadium carbide, niobium carbide, tantalum carbide and metallic chrome.

11. An electrophotographic sensitized body according to claim 10, wherein said photoconductive layer is characterized by having a two-layer structure comprising a lower photoconductive layer of hydrogenated amorphous silicon and an upper photoconductive layer of hydrogenated amorphous silicon germanium.

12. An electrophotographic sensitized body according to claim 10, wherein said photoconductive layer is characterized by having a two-layer structure comprising a lower photoconductive layer of boron-doped hydrogenated amorphous silicon and an upper photoconductive layer of hydrogenated amorphous silicon germanium.

13. An electrophotographic sensitized body which has, on a conductive substrate comprising a material selected from the group consisting of Al, Al-Si (0.2–1.2 wt. %) - Mg (0.45–1.2 wt. %) alloy, super duralmine and extra super duralmine a barrier layer comprising either hydrogenated amorphous silicon carbide or amorphous silicon carbide with a function to block the implantation of charges from the substrate into a photoconductive layer with an at-least-two-layer structure comprising hydrogenated amorphous silicon on said barrier layer; characterized by being provided between said substrate and said barrier layer with a diffusion blocking layer 0.005–5 microns in thickness which comprises a material selected from the group consisting of titanium nitride, tantalum nitride, hafnium nitride, platinum silicide, nickel silicide, palladium silicide, titanium silicide, hafnium silicide, tantalum silicide, tungsten silicide, vanadium silicide, niobium silicide, molybdenum silicide, zirconium silicide, tungsten carbide, titanium carbide, molybdenum carbide, hafnium carbide, vanadium carbide, niobium carbide, tantalum carbide and metallic chrome.

14. An electrophotographic sensitized body according to claim 13, wherein said photoconductive layer is characterized by having a two-layer structure comprising a lower photoconductive layer of hydrogenated amorhous silicon and an upper photoconductive layer of hydrogenated amorphous silicon germanium.

15. An electrophotographic sensitized body according to claim 13, wherein said photoconductive layer is characterized by having a two-layer structure comprising a lower photoconductive layer of boron-doped hydrogenated amorphous silicon and an upper photoconductive layer of hydrogenated amorphous silicon germanium.

16. An electrophotographic sensitized body which has a photoconductive layer comprising hydrogenated amorphous silicon on a conductive substrate comprising a material selected from the group consisting of Al, Al-Si (0.2–1.2 wt. %) - Mg (0.45–1.2 wt. %) alloy, super duralmine and extra super duralmine; characterized by being provided between said substrate and said photoconductive layer with a diffusion blocking layer which is composed of two layers, i.e. a lower layer 0.005–5 microns in thickness comprising metallic chrome and an upper layer 0.005–5 microns in thickness comprising a material selected from among platinum silicide, nickel silicide, palladium silicide, titanium silicide, hafnium silicide, tantalum silicide, tungsten silicide, vanadium silicide, niobium silicide, molybdenum silicide and zirconium silicide.

17. An electrophotographic sensitized body which has a barrier layer comprising hydrogenated amorphous silicon carbide and amorphous silicon carbide with a function to block the implantation of charges from a conductive substrate which comprises a material selected from the group consisting of Al, Al-Si (0.2–1.2 wt. %) - Mg (0.45–1.2 wt. %) alloy, super duralmine and extra super duralmine into a photoconductive layer which comprises hydrogenated amorphous silicon on said barrier layer; characterized by being provided between said substrate and said barrier layer with a diffusion blocking layer which is composed of two layers; a lower layer 0.005–5 microns in thickness comprising metallic chrome and an upper layer 0.005–5 microns in thickness comprising a material selected from the group consisting of platinum silicide, nickel silicide, palladium silicide, titanium silicide, hafnium silicide, tantalum silicide, tungsten silicide, vanadium silicide, niobium silicide, molybdenum silicide and zirconium silicide.

18. An electrophotographic sensitized body which has a titanium nitride layer 0.005–5 microns in thickness, and is characterized by being provided with a hydrogenated amorphous silicon carbide layer on said titanium nitride layer, a lower photoconductive layer comprising hydrogenated amorphous silicon on the said hydrogenated amorphous silicon carbide layer, an upper photoconductive layer comprising hydrogenated amorphous silicon germanium on said lower photoconductive layer and a surface coating layer comprising hydrogenated amorphous silicon carbide on said upper photoconductive layer.

19. An electrophotographic sensitized body which has a titanium nitride layer 0.005–5 microns in thickness on an aluminum substrate; characterized by being provided with an amorphous silicon carbide layer on said titanium nitride layer, a lower photoconductive layer comprising boron-doped hydrogenated amorphous silicon on said amorphous silicon, an upper photoconductive layer comprising hydrogenated amorphous silicon germanium on said lower photoconductive layer and a surface coating layer comprising amorphous silicon carbide on said upper photoconductive layer.

20. An electrophotographic sensitized body which has a metallic chrome layer and a nickel silicide layer with 0.005–5 micron total thickness on an aluminum substrate; characterized by being provided with a barrier layer comprising either amorphous silicon carbide or hydrogenated amorphous silicon on said nickel silicide layer, a lower photoconductive layer comprising either hydrogenated amorphous silicon or boron-doped hydrogenated amorphous silicon on said barrier layer, an upper photoconductive layer comprising hydrogenated amorphous silicon germanium on said lower photoconductive layer and a surface coating layer comprising either hydrogenated amorphous silicon carbide or amorphous silicon carbide on said upper photoconductive layer.

21. An electrophotographic sensitized body comprising:

a conductive substrate;

a diffusion blocking layer provided on said substrate, said diffusion blocking layer being made of a material selected from the group consisting of titanium nitride, tantalum nitride, hafnium nitride, platinum silicide, nickel silicide, palladium silicide, titanium silicide, hafnium silicide, tantalum silicide, tungsten silicide, vanadium silicide, niobium silicide, molybdenum silicide, zirconium silicide, tungsten carbide, titanium, carbide, molybdenum carbide, hafnium carbide, vanadium carbide, niobium carbide, tantalum carbide and metallic chrome; and a photoconductive layer provided over said diffusion blocking layer, said photoconductive layer comprising hydrogenated amorphous silicon.

22. An electrophotographic sensitized body according to claim 21, further comprising a barrier layer provided between said diffusion blocking layer and said photoconductive layer, said barrier layer comprising a material selected from the group consisting of hydrogenated amorphous silicon carbide and amorphous silicon carbide, wherein said barrier layer functions to block the implantation of charges from the substrate and into said photoconductive layer.

23. An electrophotographic sensitized body according to claim 21, further comprising a protective layer formed over said photoconductive layer, said protective layer being made of a material selected from the group consisting of amorphous silicon carbide and amorphous carbon.

* * * * *